US008245956B2

(12) United States Patent
Dragone et al.

(10) Patent No.: US 8,245,956 B2
(45) Date of Patent: Aug. 21, 2012

(54) ELECTROMAGNETIC FUEL INJECTOR FOR GASEOUS FUELS WITH ANTI-WEAR STOP DEVICE

(75) Inventors: Pasquale Dragone, Bologna (IT); Andrea Cobianchi, Bologna (IT); Mirco Vignoli, Zola Predosa (IT)

(73) Assignee: Magneti Marelli, Corbetta (IT)

( * ) Notice: Subject to any disclaimer, the term of this patent is extended or adjusted under 35 U.S.C. 154(b) by 354 days.

(21) Appl. No.: 12/385,896

(22) Filed: Apr. 23, 2009

(65) Prior Publication Data

US 2009/0266920 A1 Oct. 29, 2009

(30) Foreign Application Priority Data

Apr. 23, 2008 (EP) ..... 08425280

(51) Int. Cl.
*F02M 51/00* (2006.01)

(52) U.S. Cl. ..... 239/581.1; 239/533.2; 239/585.3; 251/129.15; 251/64

(58) Field of Classification Search ..... 239/533.2, 239/585.1–585.5; 251/129.15, 64
See application file for complete search history.

(56) References Cited

U.S. PATENT DOCUMENTS

| | | | | |
|---|---|---|---|---|
| 4,473,189 | A | 9/1984 | Itoh et al. | |
| 7,086,606 | B2 * | 8/2006 | Brooks et al. | 239/5 |
| 2002/0030123 | A1 | 3/2002 | Haltiner | |
| 2003/0047160 | A1 * | 3/2003 | Noller et al. | 123/294 |
| 2003/0111563 | A1 | 6/2003 | Tsuchiya et al. | |
| 2005/0017097 | A1 | 1/2005 | Hans | |
| 2006/0243829 | A1 | 11/2006 | Oomori | |

FOREIGN PATENT DOCUMENTS

| | | |
|---|---|---|
| DE | 1263396 | 3/1968 |
| DE | 3531153 | 12/1986 |
| DE | 10146141 | 4/2003 |
| DE | 102004037250 | 2/2006 |
| EP | 0404336 | 12/1990 |
| EP | 2065591 | 6/2009 |
| WO | WO 96/41947 | 12/1996 |
| WO | WO 03/002868 | 1/2003 |

OTHER PUBLICATIONS

European Search Report mailed Dec. 10, 2008 in European Application No. 08425280.8.
European Search Report mailed Oct. 6, 2009 in European Appln. No. 09158337.7.

* cited by examiner

*Primary Examiner* — Jason Boeckmann
(74) *Attorney, Agent, or Firm* — Davidson Berquist Jackson & Gowdey, LLP

(57) ABSTRACT

Electromagnetic fuel injector for gaseous fuels comprising: an injection nozzle controlled by an injection valve; a movable shutter to regulate the flow of fuel through the injection valve; an electromagnetic actuator, which is suitable to move the shutter between a closed position and an open position of the injection valve and comprises a fixed magnetic pole, a coil suitable to induce a magnetic flux in the magnetic pole, and a movable anchor suitable to be magnetically attracted by the magnetic pole; an absorption element, which is made of an amagnetic elastic material and is arranged between the magnetic pole and the anchor; and a protective element, which is made of a magnetic metal material having high surface hardness and is interposed between the absorption element and the anchor.

15 Claims, 9 Drawing Sheets

ELECTROMAGNETIC FUEL INJECTOR FOR GASEOUS FUELS WITH ANTI-WEAR STOP DEVICE

TECHNICAL FIELD

The present invention relates to an electromagnetic fuel injector for gaseous fuels.

BACKGROUND ART

An electromagnetic fuel injector comprises a tubular housing member inside which there is defined an injection chamber delimited at one end by an injection nozzle which is controlled by an injection valve governed by an electromagnetic actuator. The injection valve is provided with a shutter, which is rigidly connected to a movable anchor of the electromagnetic actuator so as to be moved under the action of said electromagnetic actuator between a closed position and an open position of the injection nozzle against the action of a closing spring that tends to hold the shutter in the closed position.

The injection valve is normally closed due to the effect of the closing spring which pushes the shutter into the closed position, in which the shutter presses against a valve seat of the injection valve and the anchor is spaced apart from a fixed magnetic armature of the electromagnetic actuator. To open the injection valve, that is to move the shutter from the closed position to the open position, a coil of the electromagnetic actuator is energized so as to generate a magnetic field which attracts the anchor towards the fixed magnetic armature against the elastic force exerted by the closing spring; in the opening phase, the stroke of the anchor ends when said anchor impacts against the fixed magnetic armature. In other words, in the opening phase of the injection valve the anchor accumulates kinetic energy which is subsequently dissipated in the impact of the anchor against the fixed magnetic armature.

When the fuel is liquid (for example petrol or diesel) the kinetic energy of the anchor is partly dissipated by the action of the fuel present between the anchor and the fixed magnetic armature; in other words, the movement of the anchor is slowed down by the fuel present between the anchor and the fixed magnetic armature which must be moved by the movement of the anchor to allow said anchor to come into contact with the magnetic armature. Consequently, when the fuel is liquid the impact of the anchor against the fixed magnetic armature is not excessively violent and does not therefore cause any appreciable wear on said components.

On the other hand, when the fuel is gaseous, (for example methane or mixtures of propane and butane), the braking action of the fuel on the anchor described above is almost non-existent and the impact of the anchor against the fixed magnetic armature is therefore particularly violent. Consequently, in fuel injectors for gaseous fuels the reciprocal contacting surfaces of the anchor and of the fixed magnetic armature are frequently subject to a considerable amount of wear with a subsequent loss of material which results in the lengthening of the anchor stroke and alters the functional characteristics of the injector. Said wear is thus eventually the cause of significant variations in the functional characteristics of the injector, making proper injection control difficult, if not impossible, both in terms of the instant in which injection starts and in terms of the amount of fuel that is injected.

A solution that has been proposed to overcome the drawbacks described above consists of interposing an element made of resilient material (e.g. elastic) between the anchor and the fixed magnetic armature. Said element can be fitted, without distinction, to the anchor or to the fixed magnetic armature, in order to limit the mechanical stress on these components when the anchor impacts against the fixed magnetic armature. However, it has been observed that the element made of resilient material tends to wear out very quickly due to the effect of the anchor continuously impacting against the fixed magnetic armature, limiting the efficiency of this structural solution.

One possible solution to this problem is to increase the thickness of the element made of resilient material in order to give said element made of resilient material greater mechanical strength and better wear resistance. However, increasing the thickness of the component made of resilient material inevitably also increases the size of the magnetic gap between the anchor and the fixed magnetic armature (the resilient material is inevitably non-ferromagnetic) and thus makes it necessary to increase the number of ampere turns of the electromagnetic actuator with a subsequent increase in the cost, weight, overall dimensions and electric power consumption of the electromagnetic actuator.

Patent applications DE102004037250A1 and US2005017097A1 describe an electromagnetic fuel injector comprising an injection nozzle controlled by an injection valve; a movable shutter to control the flow of fuel through the injection valve; an electromagnetic actuator, which is suitable to move the shutter between a closed position and an open position of the injection valve and comprises a fixed magnetic pole, a coil suitable to induce a magnetic flux in the magnetic pole, and a movable anchor suitable to be magnetically attracted by the magnetic pole; an absorption element, which is made of amagnetic elastic material; and a protective element, which is coupled to the absorption element and has the function of protecting the absorption element against the action of the fuel flowing under pressure against the absorption element through delivery holes in the anchor.

The effective functional characteristics of an electromagnetic fuel injector must not differ from its nominal functional characteristics (i.e. expected and desired characteristics) by more than a fixed percentage (generally by not more than a small percentage) defined in the project design stage. To comply with this requirement and compensate for the inevitable constructional tolerances of all the components, at the end of the production line the electromagnetic fuel injectors are adjusted or calibrated during an operation which normally consists of adjusting the pre-load of the closing spring (i.e. the elastic force generated by the closing spring). In particular, in electromagnetic fuel injectors the pre-load of the closing spring is adjusted so that the effective injection rate is equal to the nominal injection rate.

However, it has been observed that by adjusting the pre-load of the closing spring it is possible to obtain an effective injection rate that is equal to the nominal injection rate, although this produces a significant fluctuation in the dynamic characteristics of the fuel injectors. In other words, although the high fluctuation of the pre-load of the closing spring obtained by performing the calibration described above makes it possible to standardize the effective injection rate (i.e. fuel injector behaviour in the stationary condition), it also causes notable differences in the dynamic characteristics of the fuel injectors (i.e. fuel injector behaviour in the transient state). Said differences in the dynamic characteristics make it very complicated to control a fuel injector to perform very short injections (for instance as in the sequence of pilot injections preceding the main injection) in which said fuel injector is always in the transient state.

DISCLOSURE OF THE INVENTION

The purpose of the present invention is to produce an electromagnetic fuel injector for gaseous fuels, in which said fuel injector overcomes the drawbacks described above, is simple and cost-effective to produce and in which the original functional characteristics are subject to limited alteration in time.

According to the present invention an electromagnetic fuel injector for gaseous fuels is produced according to that set forth in the attached claims.

BRIEF DESCRIPTION OF THE DRAWINGS

The present invention will now be described with reference to the attached drawings, illustrating some non-limiting embodiments thereof, in which.

PREFERRED EMBODIMENT OF THE INVENTION

Figure 1:
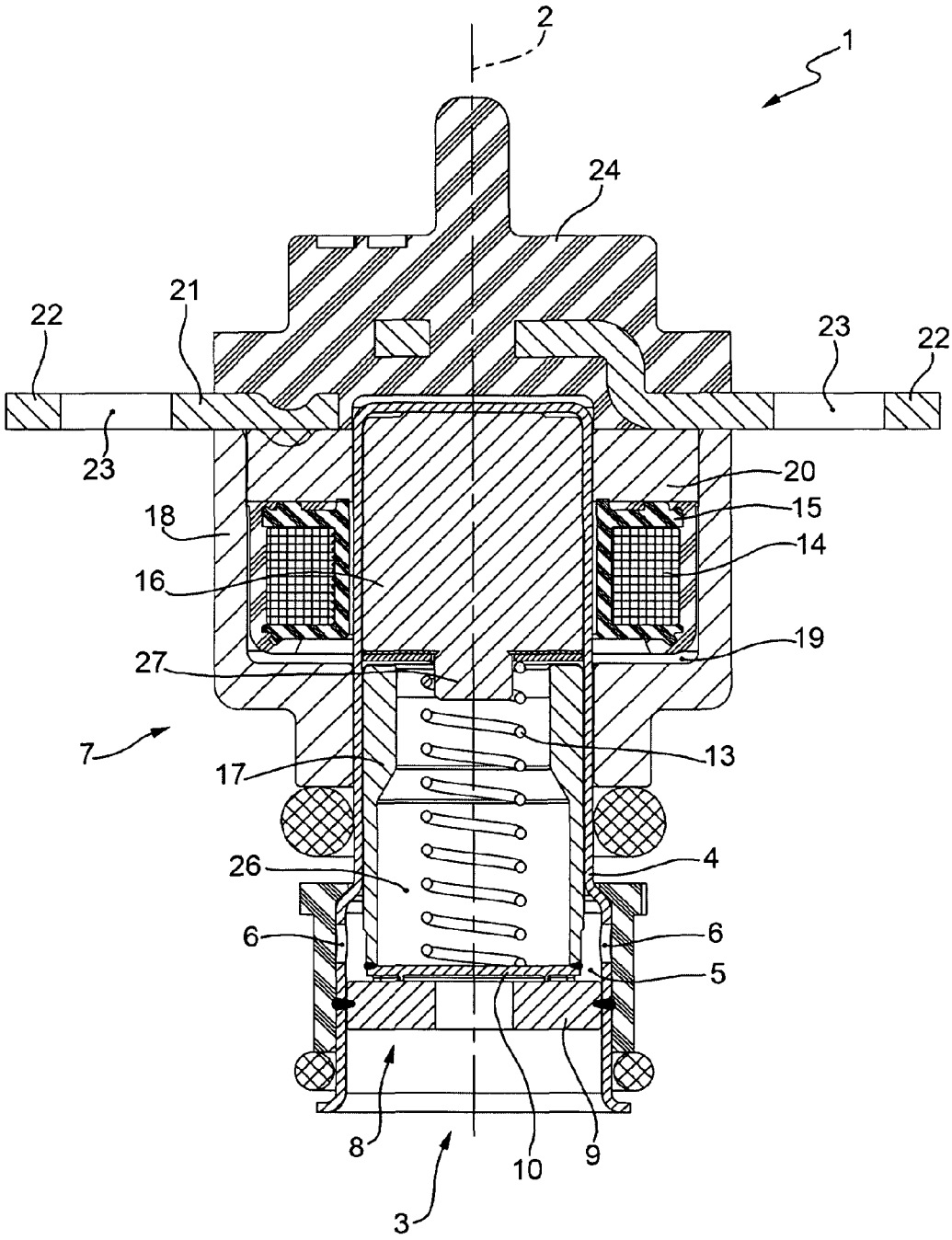
FIG. 1 is a schematic side cross-sectional view, in which some parts have been removed for the sake of clarity, of an electromagnetic fuel injector according to the present invention.

In FIG. 1, number 1 indicates a fuel injector as a whole, which is essentially cylindrically symmetrical about a longitudinal axis 2 and is controlled to inject fuel through an injection nozzle 3. As described more fully below, the fuel injector 1 receives the fuel radially (i.e. perpendicularly to the longitudinal axis 2) and injects the fuel axially (i.e. along the longitudinal axis 2).

The fuel injector 1 comprises a tubular body 4, which is closed superiorly, is made by means of a drawing process out of ferromagnetic steel, and is provided with a cylindrical seat 5 the lower portion of which acts as a fuel duct. In particular, a lower portion of the tubular body 4 is provided with six radial through holes 6, which are arranged perpendicularly to the longitudinal axis 2, are distributed evenly about the longitudinal axis 2 and have the function of allowing the fuel to enter the cylindrical seat 5 in a radial manner.

The supporting body 4 houses an electromagnetic actuator 7 in an upper portion thereof and houses an injection valve 8 in a lower portion thereof which inferiorly delimits the cylindrical seat 5; in use, the injection valve 8 is activated by the electromagnetic actuator 7 to regulate the flow of fuel through the injection nozzle 3, which is obtained in correspondence with said injection valve 8.

A closing disk 9 is arranged inside the cylindrical seat 5 and beneath the radial holes 6. Said closing disk 9 is part of the injection valve 8, is welded laterally to the tubular body 4, and is provided with a central through hole which defines the injection nozzle 3. A discoidal shutter 10 is connected to the closing disk 9. Said shutter 10 is part of the injection valve 8 and is movable between an open position, in which the shutter 10 is raised from the closing disk 9 and the injection nozzle 3 communicates with the radial holes 6, and a closed position, in which the shutter 10, pressed against the closing disk 9 and the injection nozzle 3, is isolated from the radial holes 6.

Figure 2:
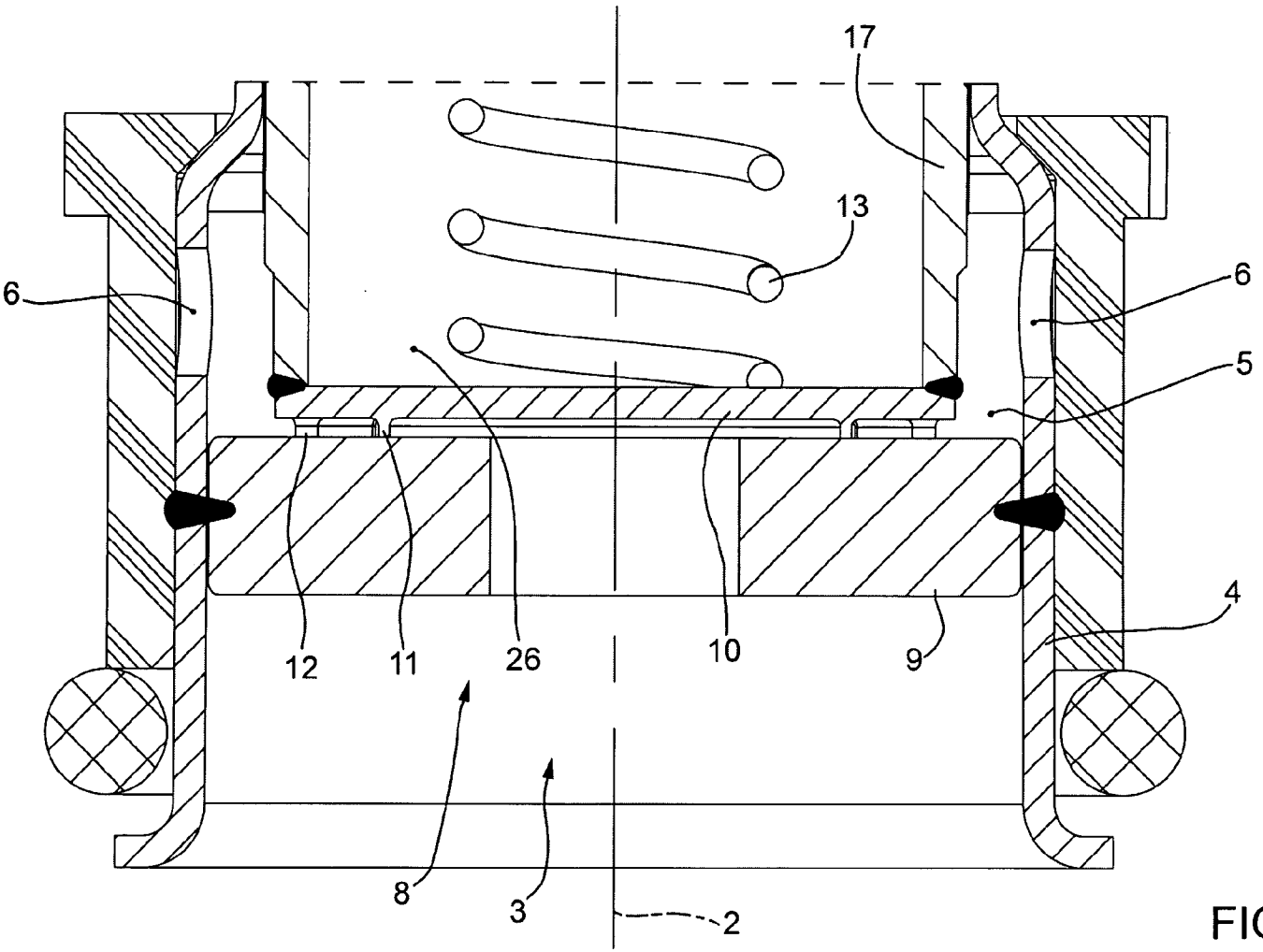
FIG. 2 is a view on an enlarged scale of an injection valve of the electromagnetic fuel injector of FIG. 1.

According to that illustrated in FIG. 2, starting from a bottom surface of the shutter 10 facing towards the closing disk 9 an inner ring 11 the diameter of which is slightly greater than the central through hole of the closing disk 9 and an outer ring 12 arranged in correspondence with the outer edge of the shutter 10 rise in a cantilevered fashion. The inner ring 11 defines a sealing element, which is suitable to isolate the injection nozzle 3 from the radial holes 6 when the shutter 10 is arranged in the closed position resting against the closing disk 9.

According to the illustration in FIG. 1, the shutter 10 is held in the closed position resting against the closing disk 9 by a closing spring 13 which is compressed between an upper surface of the shutter 10 and an upper wall of the tubular body 4. The electromagnetic actuator 7 is operated to move the shutter 10 from the closed position to the open position against the action of the closing spring 13.

The electromagnetic actuator 7 comprises a coil 14, which is arranged externally about the tubular body 4 and is enclosed in a toroidal plastic case, and a fixed magnetic pole 16, which is made of ferromagnetic material and is arranged inside the tubular body 4 in correspondence with the coil 14. Moreover, the electromagnetic actuator 7 comprises a movable anchor 17, which is cylindrical in shape, is made of ferromagnetic material, is mechanically connected to the shutter 10, and is suitable to be magnetically attracted by the magnetic pole 16 when the coil 14 is energized (i.e. when current passes through it). Lastly, the electromagnetic actuator 7 comprises a tubular magnetic armature 18, which is made of ferromagnetic material, is arranged on the outside of the tubular body 4 and comprises an annular seat 19 to house the coil 14, and an annular magnetic washer 20, which is made of ferromagnetic material and is arranged above the coil 14 to guide the closing of the magnetic flux about said coil 14. A metal lock ring 21 is arranged above the magnetic washer 20 and about the tubular body 4, to hold the magnetic washer 20 and coil 14 in place and prevent the magnetic washer 20 and coil 14 from coming away from the tubular body 14. The lock ring 21 preferably has two lateral expansions, each of which is traversed by a through hole 23 and used for the mechanical anchorage of the fuel injector 1.

Figure 4:
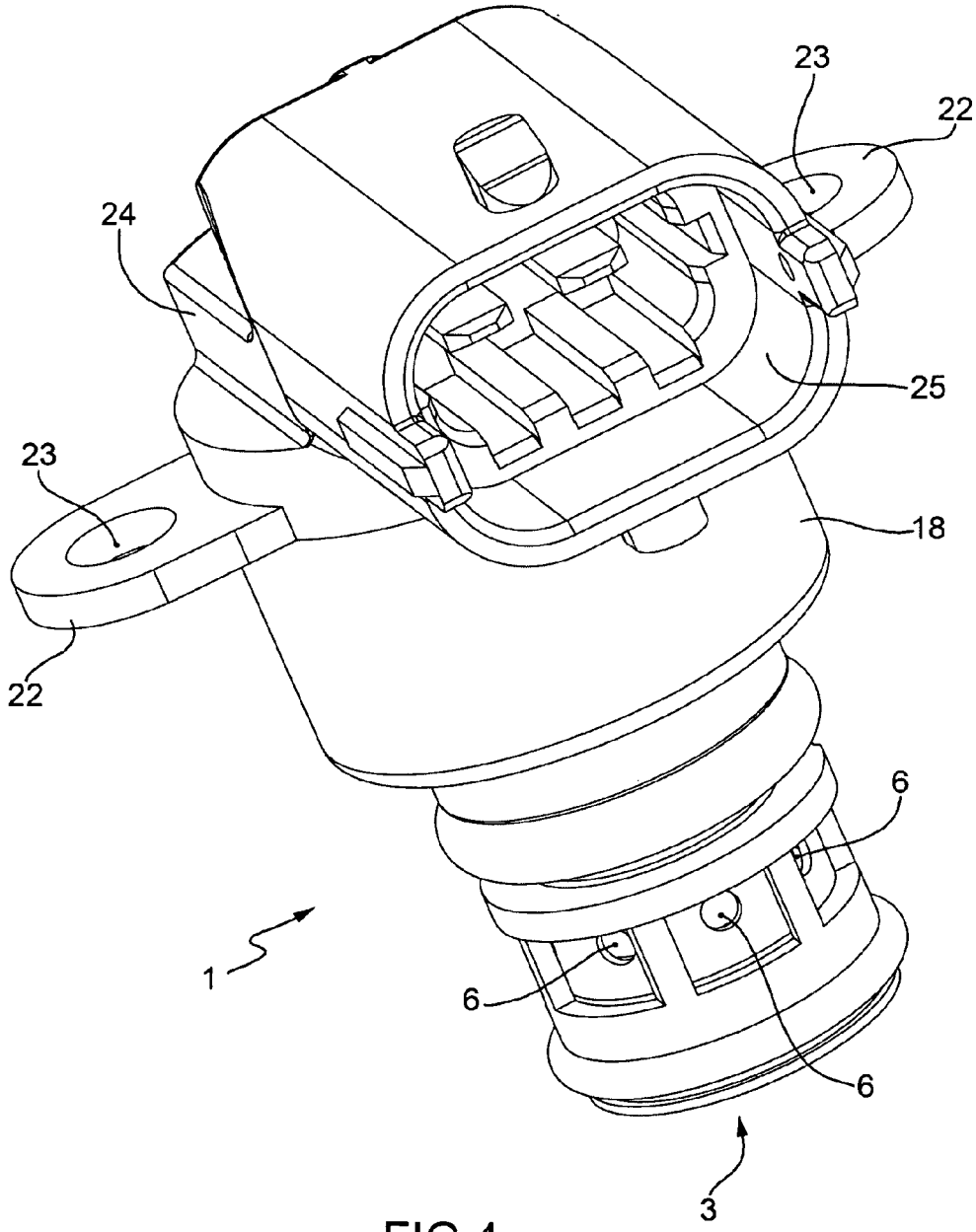
FIG. 4 is a schematic perspective view, in which some parts have been removed for the sake of clarity, of the fuel injector of FIG. 1.

A plastic cap 24 is co-pressed onto the top of the lock ring 21 and an electric connector 25 is obtained on said cap 24 (illustrated in FIG. 4) with the function of providing the electric connection between the coil 14 of the electromagnetic actuator 7 and an external electronic control unit (not illustrated).

The anchor 17 is tubular in shape and is welded inferiorly to the shutter 10 in correspondence with the outer edge of said shutter 10. The closing spring 13 is preferably arranged through a central through hole 26 in the anchor 17, rests inferiorly on an upper surface of the shutter 10, and in correspondence with an upper extremity thereof fits in a centrally arranged cylindrical protuberance 27 of the magnetic pole 16.

In use, when the electromagnetic actuator 7 is de-energized the anchor 17 is not attracted by the magnetic pole 16 and the elastic force of the closing spring 13 pushes the anchor 17 with the shutter 10 downwards and against the closing disk 9; in this situation the shutter 10 is pressed against the closing disk 9 preventing fuel from flowing out of the injection nozzle 3. When the electromagnetic actuator 7 is energized, the anchor 17 is magnetically attracted by the magnetic pole 16 against the elastic force of the closing spring 13 and the anchor 17 with the shutter 10 moves upwards until the anchor 17 impacts against the magnetic pole 16; in this condition, the shutter 10 is raised from the closing disk 9 and the pressurized fuel can flow through the injection nozzle 3.

Figure 3:
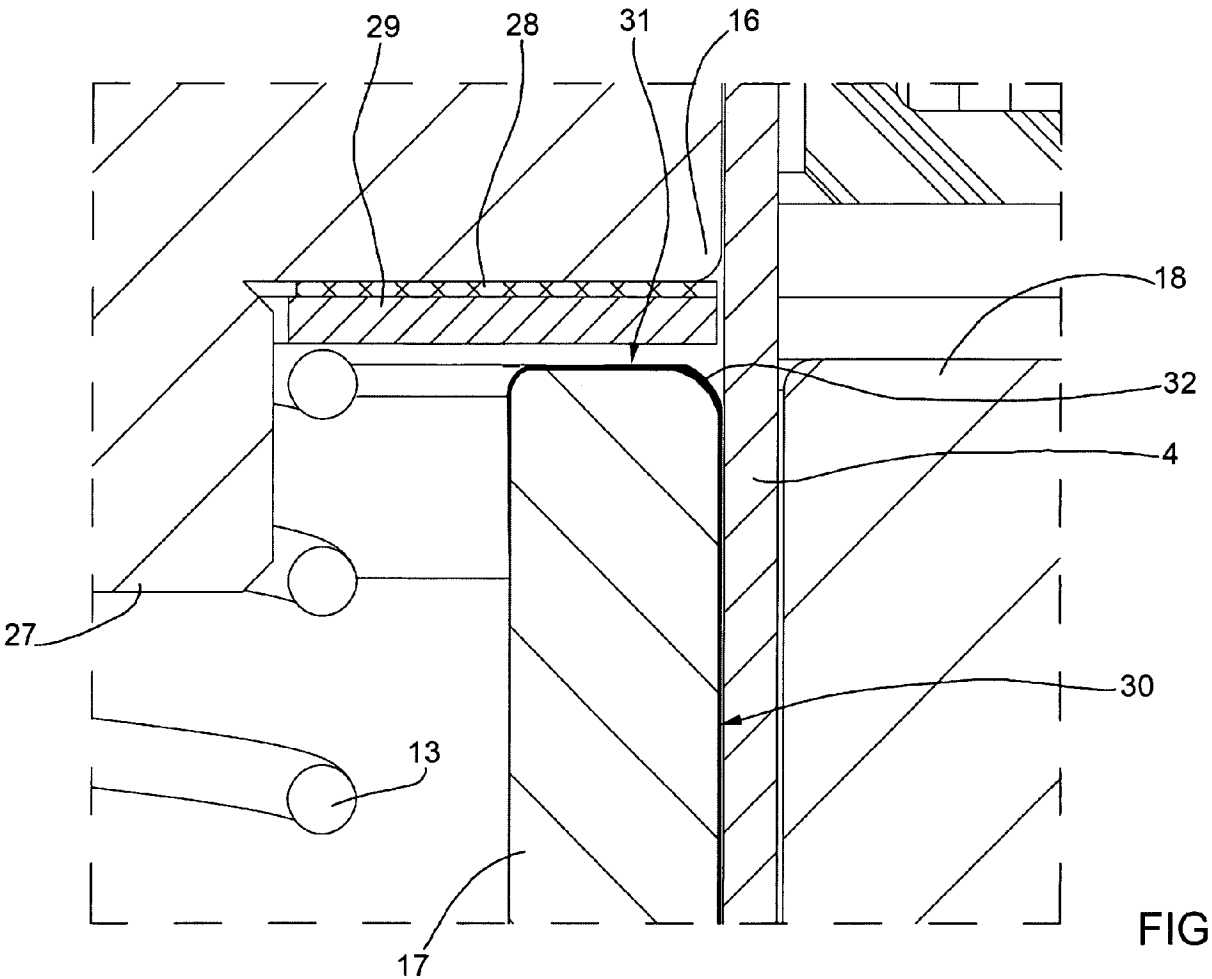
FIG. 3 is view on an enlarged scale of an electromagnetic actuator of the electromagnetic fuel injector of FIG. 1.

According to that better illustrated in FIG. 3, the fuel injector 1 comprises an absorption element 28, which is discoidal in shape with a hole in the centre, is made of an elastic amagnetic (resilient) material with good elastic properties (typically rubber or a similar material), and is fixed to the magnetic pole 16 so as to be arranged between said magnetic pole 16 and the anchor 17 (in particular it is fitted on the protuberance 27 in the centre of the magnetic pole 16). Moreover, the fuel injector 1 comprises a protective element 29, which is discoidal in shape with a hole in the centre, is made of a magnetic metal material with a high surface hardness (for example hardened magnetic steel), and is fixed to the magnetic pole 16 so as to be arranged between the absorption element 28 and the anchor 17 (in particular it is fitted on the protuberance 27 in the centre of the magnetic pole 16). By way of example, the absorption element 28 has a thickness in the region of 100 micron, while the protective element 29 has a thickness in the region of 300 micron.

The purpose of the absorption element 28 is to absorb the kinetic energy of the anchor 17 when the anchor 17 moves from the closed position to the open position and impacts against the magnetic pole 16 so as to limit the mechanical stress on these components. Moreover, the purpose of the absorption element 28 is to prevent the magnetic bonding of the anchor 17 to the magnetic pole 16 by always maintaining a minimum magnetic gap between the anchor 17 and the magnetic pole 16. The purpose of the protective element 29 is to protect the absorption element 28 against the impacts of the anchor 17 and protect said absorption element 28 from excessive wear. In other words, when it moves from the closed position to the open position the anchor 17 does not impact directly against the absorption element 28, but impacts against the protective element 29 which in turn transfers the energy of the impact to the absorption element 28.

It is important to note that it is essential for the protective element 29 to be made of ferromagnetic material in order to reduce the overall thickness of the magnetic gap between the anchor 17 and the magnetic pole 16 as much as possible; by reducing the overall thickness of the magnetic gap between the anchor 17 and the magnetic pole 16 it is possible to reduce the number of ampere turns of the coil 14 and thus the cost, weight, overall dimensions and electric power consumption of the coil 14.

According to that better illustrated in FIG. 3, an outer cylindrical surface 30 of the anchor 17 and an upper annular surface 31 of the anchor 17 are coated with a layer 32 of chrome (approximately with a thickness of 20-30 micron); it is important to point out that chrome is an amagnetic metal, with a low sliding friction coefficient (less than half that of steel) while at the same time having a high surface hardness. The purpose of the layer 32 of chrome on the upper annular surface 31 of the anchor 17 is to increase the surface hardness locally to better withstand the impacts of the anchor 17 against the magnetic pole 16 (or rather against the protective element 29). The purpose of the layer 32 of chrome on the outer cylindrical surface 30 of the anchor 17 is to facilitate the sliding of the anchor 17 with respect to the tubular body 4 and also to render the lateral magnetic gap uniform (always maintaining a minimum magnetic gap between the anchor 17 and the annular body 4) in order to prevent lateral magnetic bonding and balance the radial magnetic forces.

According to a preferred embodiment the shutter 10 is made of high-yield steel with a reduced thickness so as to be elastically deformable in the centre; in that connection it is important to point out that the shutter 10 is only welded to the anchor 17 in correspondence with its outer edge and is therefore elastically deformable in the centre. Said elastic deformation of the shutter 10 allows any clearance or structural tolerance to be recovered without undermining the sealing efficiency of said shutter 10. Moreover, when the shutter 10 moves from the open position to the closed position, the closing spring 13 pushes the shutter 10 against the closing disk 9 until said shutter 10 impacts against the closing disk 9; thanks to the flexibility of the central part of the shutter 10, the impact of the shutter 10 against the closing disk 9 is absorbed by the outer ring 12 and is not absorbed by the inner ring 11 which must have a high degree of flatness to guarantee sealing efficiency. In other words, the instant the shutter 10 impacts against the closing disk 9, the shutter 10 undergoes an elastic deformation in the central part resulting in a slight raising of the inner ring 11 which therefore does not have to absorb the energy generated by the impact.

The injector 1 described above and illustrated in FIGS. 1-4 has numerous advantages, in that it is simple and inexpensive to produce and above all even when it is used to inject gaseous fuels its functional characteristics remain highly stable in time. In particular, tests have shown that thanks to the presence of the absorption element 28 the impacts of the anchor 17 against the magnetic pole 16 do not produce appreciable wear on the surfaces of these components. Moreover, thanks to the presence of the protective element 29 the impacts of the anchor 17 do not produce significant wear on the absorption element 28. Consequently, in the fuel injector 1 described above the stroke of the anchor 17 does not increase in time and thus the functional characteristics of the fuel injector 1 remain very stable in time.

During the assembly of the fuel injector 1 illustrated in FIGS. 1-4, one of the last operations consists of welding the closing disk 9 to the tubular body 4; this operation is actually performed during an adjustment or calibration phase in that the exact axial position of the closing disk 9 on the tubular body 4 is determined experimentally in order to compensate for any clearance or structural tolerance and thus achieve a fuel injector 1 in which the level of efficiency is equal to or very close to its nominal efficiency. In particular, the axial position of the closing disk 9 is adjusted to obtain an effective injection rate equal to the nominal injection rate. This result is achieved thanks to the fact that when the axial position of the closing disk 9 is varied, so too is the compression of the closing spring 13 and thus the pre-load of the closing spring 13 (i.e. the elastic force generated by the closing spring 13).

However, while it has been observed that by varying the pre-load of the closing spring 13 it is in fact possible to achieve an effective injection rate that is equal to the nominal injection rate, on the other hand there is a significant fluctuation in the dynamic characteristics of the fuel injectors 1. In other words, while on the one hand the significant fluctuation in the pre-load of the closing spring 13 as a result of the adjustment described above makes it possible to standardize the effective injection rate (i.e. the behaviour of the fuel injectors 1 in the stationary condition), on the other it results in considerable differences in the dynamic characteristics of the fuel injectors 1 (i.e. the behaviour of the fuel injectors 1 in the transient state). Said differences in the dynamic characteristics make it difficult to control a fuel injector 1 to perform very short fuel injections (for instance in the sequence of pilot injections preceding the main injection) in which said fuel injector 1 is always in the transient state.

The drawback described above can be overcome, maintaining the pre-load of the closing spring 13 constant, by keeping the axial position of the closing disk 9 constant and varying the overall magnetic reluctance of the magnetic circuit 33 traversed by the magnetic flux 34 (schematically illustrated by the dashed line in FIG. 5) generated by the electromagnetic actuator 7. When the pre-load of the closing spring 13 is varied, so too is the force of magnetic attraction that the electromagnetic actuator 7 must generate on the anchor 17 to move said anchor 17 and overcome the elastic force produced by the closing spring 13; in other words, the standard method of adjustment consists of maintaining the force of magnetic attraction generated by the electromagnetic actuator 7 constant and varying the pre-load of the closing spring 13 to adapt the pre-load of the closing spring 13 to the force of magnetic attraction generated by the electromagnetic actuator 7. An adjustment that can create the same effect by maintaining the pre-load of the closing spring 13 as a constant force and adapting the force of magnetic attraction generated by the electromagnetic actuator 7 to the pre-load of the closing spring 13. In particular, with the same number of ampere turns (i.e. without touching the coil 14), the force of magnetic attraction generated by the electromagnetic actuator 7 can be adjusted by varying the overall magnetic reluctance of the magnetic circuit 33 traversed by the magnetic flux 34 generated by the electromagnetic actuator 7.

Figure 5:
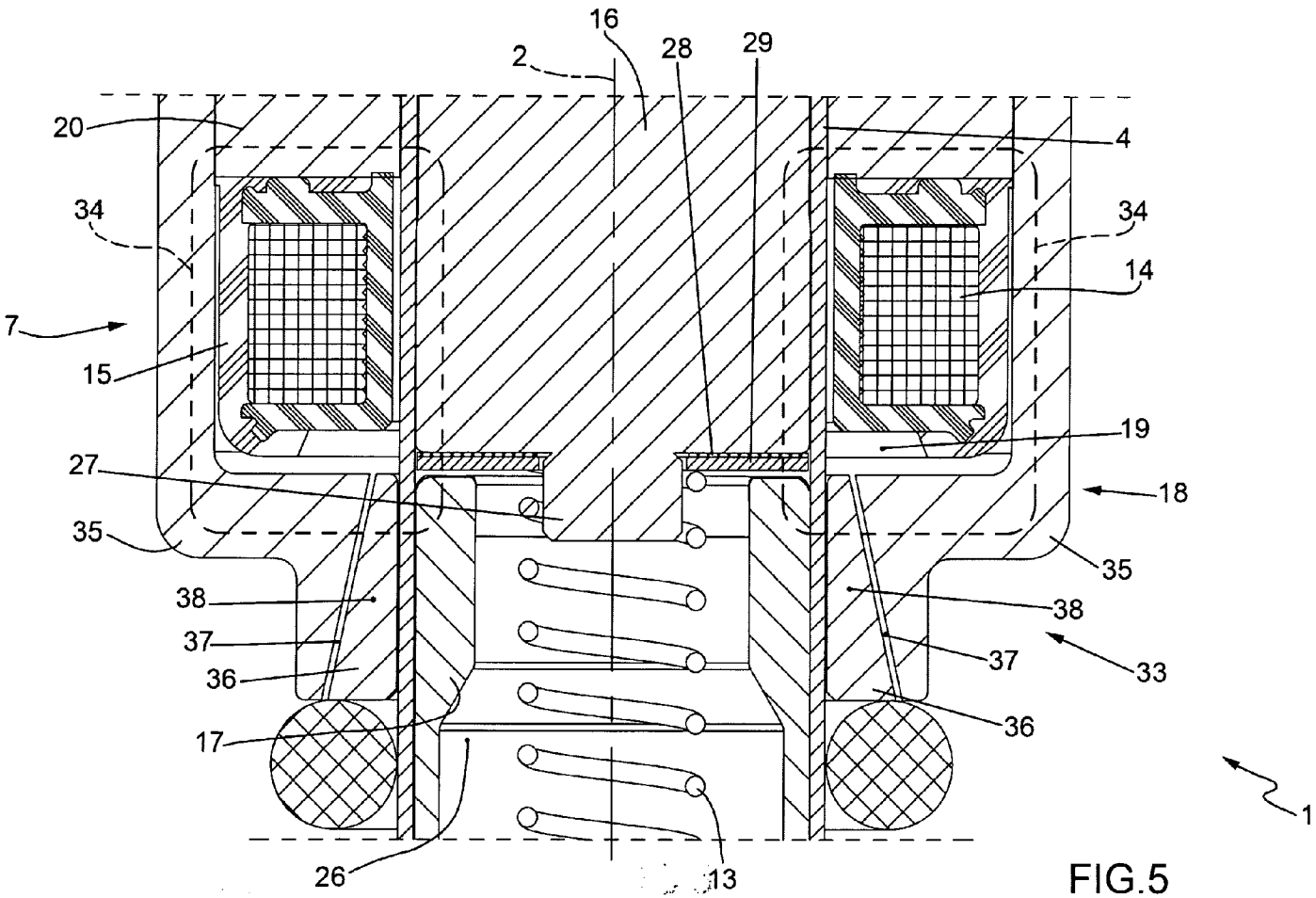
FIG. 5 is a schematic side cross-sectional view, in which some parts have been removed for the sake of clarity, of an alternative embodiment of the electromagnetic actuator of the fuel injector of FIG. 1.

According to that illustrated in FIG. 5, to enable the adjustment of the overall magnetic reluctance of the magnetic circuit 33 traversed by the magnetic flux 34, the magnetic armature 18 consists of two annular components 35 and 36 which are initially separate from one another. An inner annular component 36 is initially interference fitted on the tubular body 4; an outer annular component 35 is then gradually fitted around the inner annular component 36 in order to vary the relative axial position between the two annular components 35 and 36 and so that it is gradually interference fitted on said internal annular component 36. Alternatively, instead of gradually fitting the outer annular component 35 around the inner annular component 36, the inner annular component 36 can gradually be fitted inside the outer annular component 35; in this case, it is the outer annular component 35 that is initially fitted on the tubular body 4. When the relative axial position between the two annular components 35 and 36 is varied, so too is the size of the annular gap 37 between the two annular components 35 and 36 and thus the thickness and/or the area of the magnetic gap that must be traversed by the magnetic flux 34 in order to pass between said two annular components 35 and 36.

According to a possible embodiment, the inner annular component 36 can be open (i.e. with a transverse interruption) for greater radial elasticity and thus to reduce the mechanical stress to which the tubular body 4 is exposed during interference fitting. In this way, the tubular body 4 is not subject to any significant deformation during interference fitting; it is in fact extremely important to avoid any significant deformation of the tubular body 4, in that a deformation of the tubular body 4 can result in mechanical interference between the tubular body 4 and the anchor 17 with subsequent blockage of the sliding of the anchor 17 which would made the fuel injector 1 completely useless.

According to the embodiment illustrated in FIG. 5, the area of contact between the two annular components 35 and 36 is arranged outside the tubular body 4 in correspondence with the anchor 17 and presents the annular gap 37 the size of which varies according to the relative axial position between the two annular components 35 and 36. The outer annular component 35 has a tubular truncated cone-shaped lower portion with an inside diameter that is greater than the outside diameter of the tubular body 4 in order to define therein an annular chamber 38; the inner annular component 36 has a tubular truncated cone shape which positively reproduces the shape of the lower portion of the outer annular component 35 and gradually enters the annular chamber 38 in order to gradually vary the relative axial position between the two annular components 35 and 36.

Figure 6:
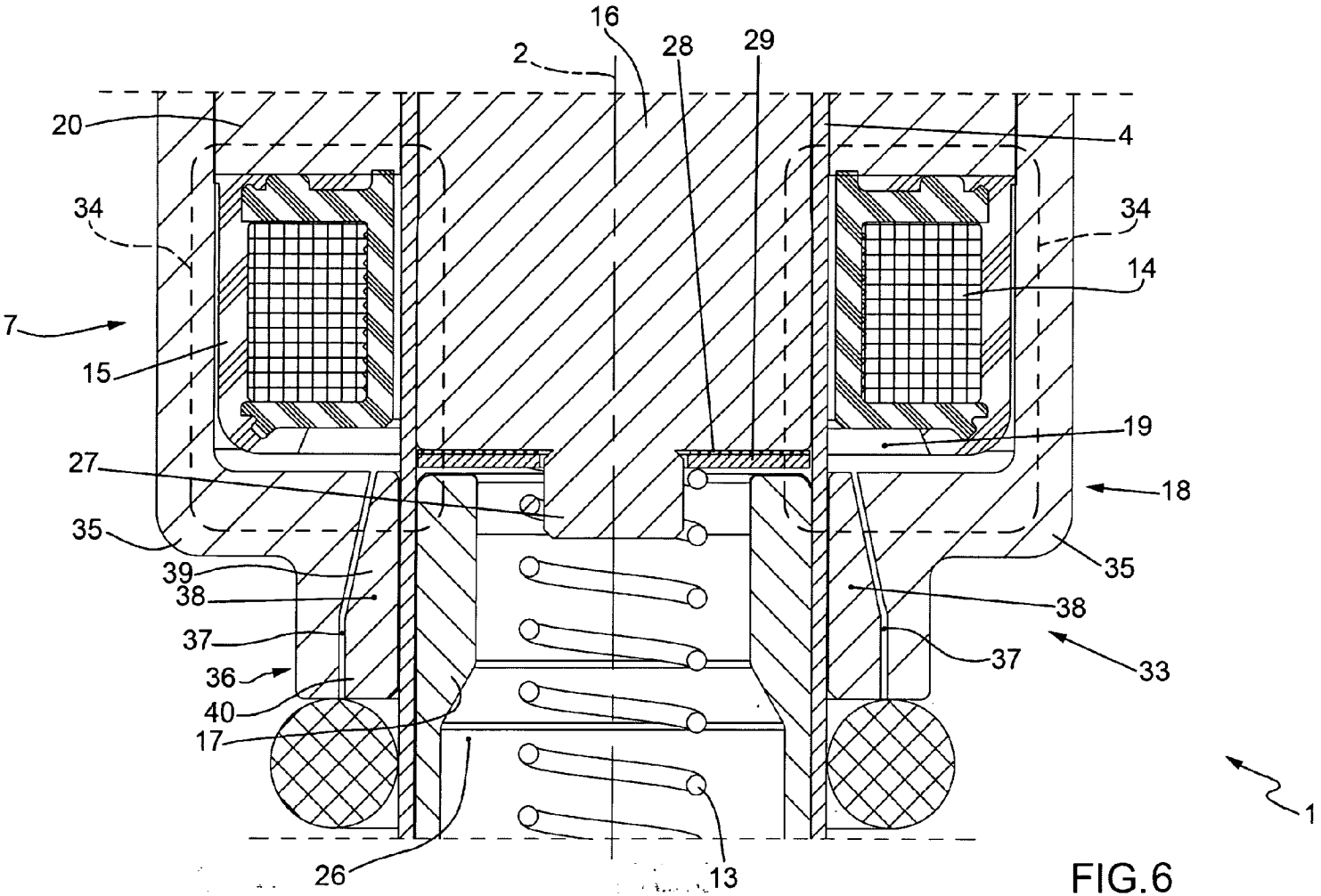
FIG. 6 is a schematic side cross-sectional view, in which some parts have been removed for the sake of clarity, of a further alternative embodiment of the electromagnetic actuator of the fuel injector of FIG. 1.

According to the alternative embodiment illustrated in FIG. 6, the inner annular component 36 has a truncated cone-shaped upper portion 39 and a cylindrically-shaped lower portion 40; the truncated cone-shaped upper portion 39 defines with the outer annular component 35 the variable magnetic gap 37 which must be traversed by the magnetic flux 34 in order to pass between said two annular components 35 and 36, while the cylindrically-shaped lower portion 40 defines the interference fitting between the inner annular component 36 and the outer annular component 35. This embodiment enables a further reduction in the mechanical stress on the tubular body 4 during interference fitting between the inner annular component 36 and the outer annular component 35; in this way, the tubular body 4 is essentially protected against any form of deformation induced by the interference fitting between the inner annular component 36 and the outer annular component 35. As mentioned previously, it is extremely important to avoid any deformation whatsoever of the tubular body 4, in that a deformation of the tubular body 4 could lead to mechanical interference between the tubular body 4 and the anchor 17 with the subsequent blockage of the sliding of the anchor 17 which would make the fuel injector 1 completely useless.

Thanks to the fact that the interference fitting between the two annular components 35 and 36 causes no appreciable deformation of the tubular body 4, interference fitting can be performed with a sufficiently high fitting force to guarantee the long-term stability of said interference fitting.

The injector 1 described above and illustrated in FIG. 5 has numerous advantages, in that it is simple and inexpensive to produce and above all it allows the functional characteristics to be adjusted while maintaining the pre-load of the closing spring 13 constant. Given the numerous advantages of the injector 1 described above and illustrated in FIG. 5, the particular arrangement of the magnetic armature 18 can also be used for a fuel injector for liquid fuels.

According to the embodiment illustrated in FIG. 3, the protective element 29 consists of a disk made of ferromagnetic metal material with a central through hole. Said embodiment has some drawbacks, in that the protective element 29 must necessarily be mounted floatingly (and thus be free to move axially), i.e. it cannot be fixed (normally welded or interference fitted) centrally with respect to the protuberance 27 of the magnetic pole 16 or laterally with respect to the tubular body 4 because if fixed centrally or laterally it alone would absorb (almost) all of the impact of the anchor 17 and actually prevent the absorption element 28 from elastically deforming and absorbing the energy of the impact, ultimately preventing the absorption element 28 from performing its function. However, the fact that the protective element 29 is floatingly mounted has the important drawback that in use the protective element 29 vibrates transversely with respect to the longitudinal axis 2 cyclically impacting against the protuberance 27 of the magnetic pole 16 and/or against the tubular body 4 resulting in gradual wear on said components (i.e. as the protective element 29 vibrates transversely it locally "eats into" the protuberance 27 of the magnetic pole 16 and/or the tubular body 4).

Moreover, it has been observed that with the protective element 29 according to the embodiment illustrated in FIG. 3 the life of the absorption element 28 can be extended, although it does not enable the absorption element 28 to achieve a very long life. To limit the overall thickness of the magnetic gap between the anchor 17 and the magnetic pole 16 the thickness of the protective element 29 must be extremely limited; thus when the anchor 17 impacts against the magnetic pole 16 the compression of the protective element 29 may exceed the elasticity limit and thus produce permanent deformations of said protective element 29.

Figure 7:
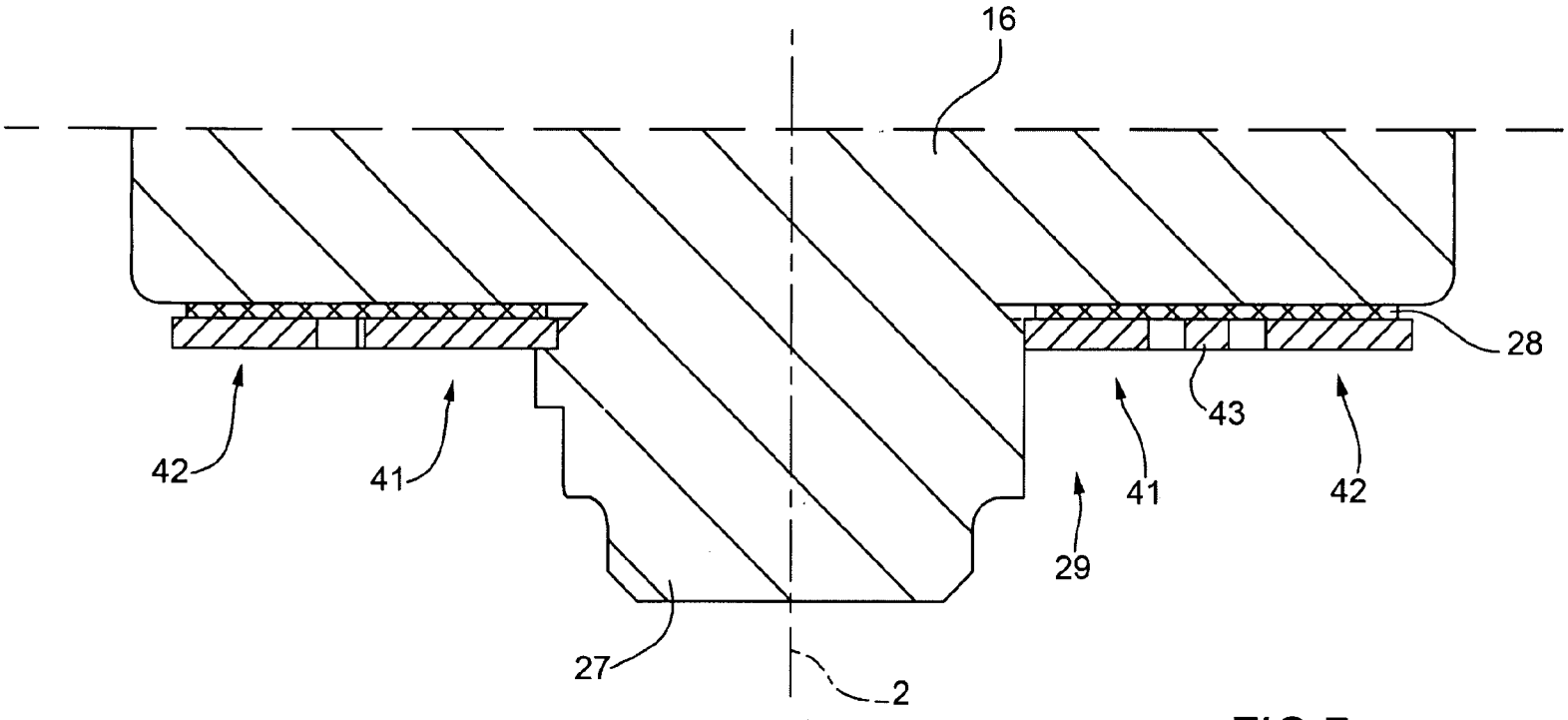
FIG. 7 is a view on an enlarged scale and in which some parts have been removed for the sake of clarity, of an absorption element coupled to a protective element according to the present invention.
Figure 8:
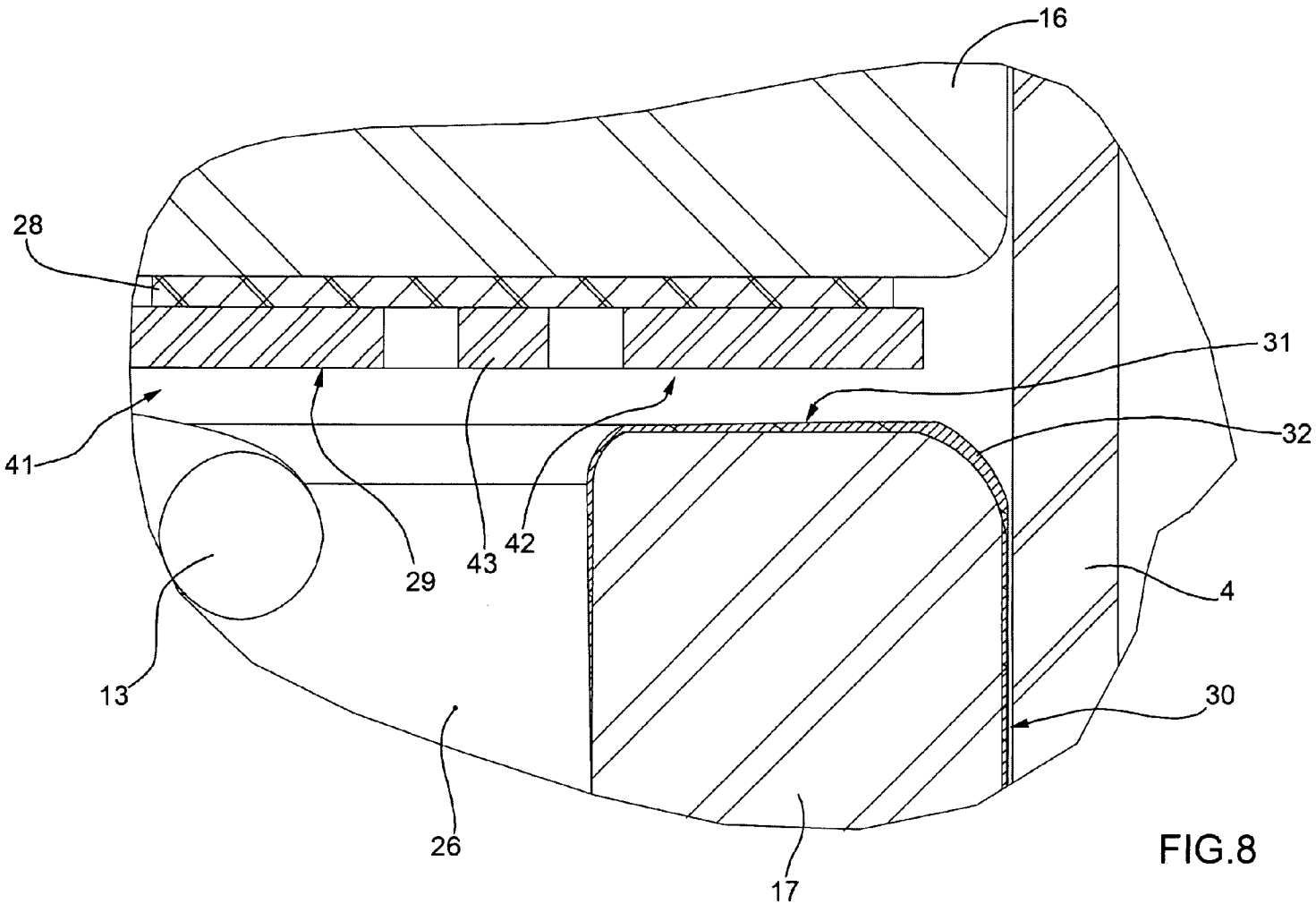
FIG. 8 is a view on an enlarged scale of a detail of the protective element of FIG. 7.
Figure 9:
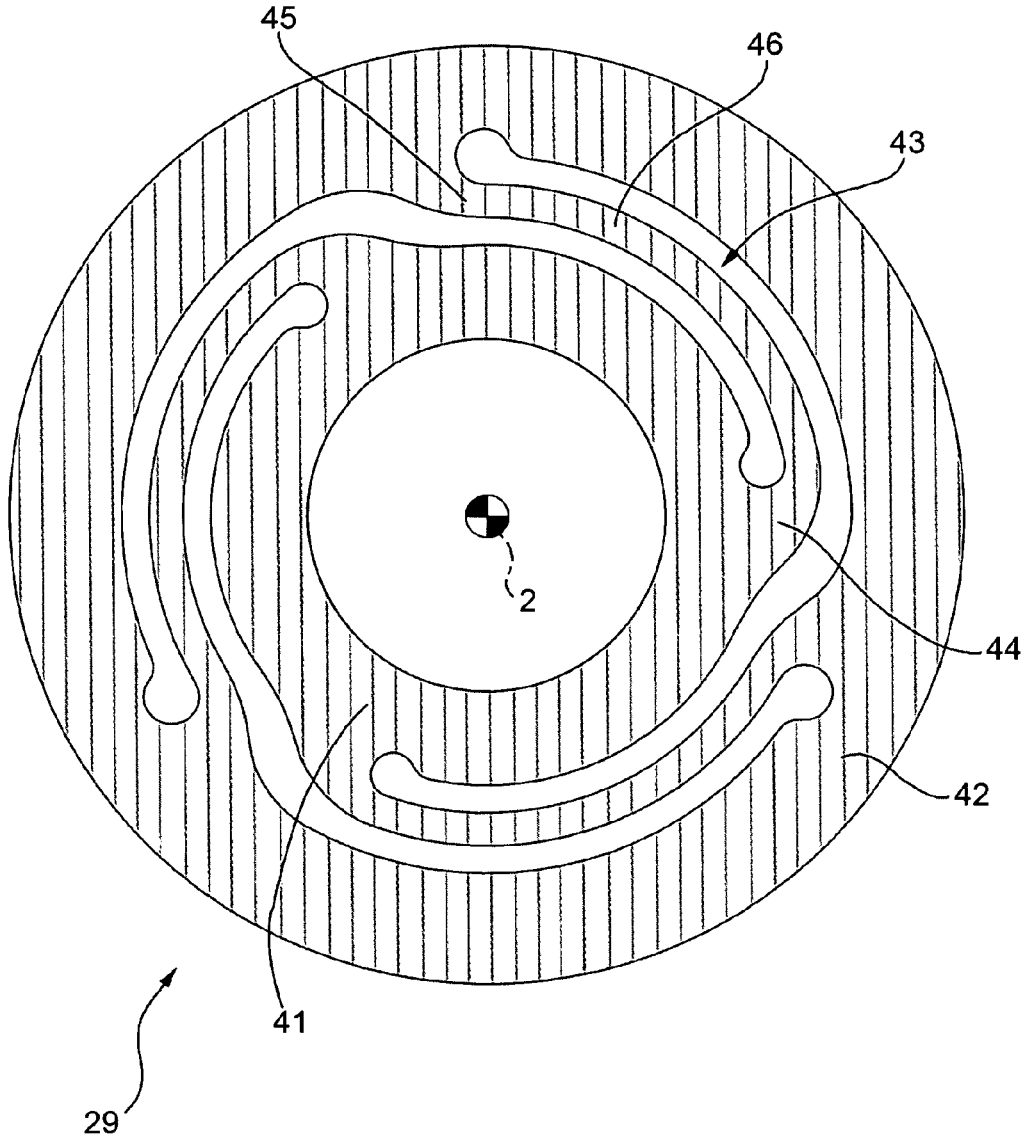
FIG. 9 is a plan view of the protective element of FIG. 7.

According to the embodiment illustrated in FIGS. 7-9, the protective element 29 comprises an inner annular portion 41, an outer annular portion 42 arranged concentrically around the inner portion 41, and a plurality of connecting arms 43, each of which connects the inner portion 41 to the outer portion 42 and has an internal extremity 44 that is integral with the inner portion 41 and an external extremity 45 that is integral with the outer portion 42.

According to that illustrated in FIG. 9, there are three connecting arms 43 distributed symmetrically around the longitudinal axis 2 and each of which is arranged circumferentially, i.e. extending along an arc of circumference centred on the longitudinal axis 2. In particular, each connecting arm 43 has a central part 46 that is perfectly circumferential and two extremities 44 and 45 that are joined radially (i.e. perpendicularly to the longitudinal axis 2) to the portions 41 and 42 so as to be connected to the central part 46.

By altering the number of connecting arms 43, the cross-section of the central part 46 of each connecting arm 43, and/or the length of the central part 46 of each connecting arm 43 it is possible to alter the total elasticity and deformability of the connecting arms 43, and thus alter the total elasticity and deformability present between the inner portion 41 and the outer portion 42.

It is important to observe that, as shown in FIG. 8, the radius of the central through hole 26 of the anchor 17 is greater than the outside radius of the connecting arm 43 or the interconnecting structure between the inner portion 41 and the outer portion 42 of the protective element 29; this means that the anchor 17 can only touch the outer portion 42 and can never touch the inner portion 41 or the connecting arms 43.

According to that illustrated in FIG. 7, the inner portion 41 of the protective element 29 is fixed centrally (welded or interference fitted) to the protuberance 27 of the magnetic pole 16 while the outer portion 42 of the protective element 29 is free to move axially with respect to the inner portion 41 thanks to the elastic deformation of the connecting arms 43. According to an equivalent embodiment that is not illustrated, the outer portion 42 of the protective element 29 is fixed laterally (welded or interference fitted) to the tubular body 4 while the inner portion 41 of the protective element 29 is free to move axially with respect to the outer portion 42 thanks to the elastic deformation of the connecting arms 43; in this case, at least the upper portion of the anchor 17 must be shaped in such a way that the anchor 17 can only touch the inner portion 41 and can never touch the outer portion 42 or the connecting arms 43.

Thanks to the fact that a portion 41 or 42 of the protective element 29 is fixed to the protuberance 27 of the magnetic pole 16 or to the tubular body 4, in use the protective element 29 does not vibrate transversely with respect to the longitudinal axis 2 and therefore does not cause any wear due to contact with the protuberance 27 or the tubular body 4.

In use, when the anchor 17 moves from the closed position to the open position towards the magnetic pole 16, the anchor 17 initially impacts against the outer portion 42 of the protective element 29 and, due to the effect of the kinetic energy of the anchor 17, it moves the outer portion 42 axially and elastically deforms the connecting arms 43 until the outer portion 42 comes into contact with the absorption element 28 which is thus deformed and absorbs part of the kinetic energy of the anchor 17. As described previously, the anchor 17 only touches the outer portion 42 of the protective element 29 and never touches the inner portion 41 or the connecting arms 43; the connecting arms 43 are thus freely elastically deformable so as to allow an axial movement between the outer portion 42 pushed by the anchor 7 and the inner portion 41 which, since it is fixed to the protuberance 27 of the magnetic pole 16, does not move.

During the opening movement when the anchor 17 impacts against the outer portion 42 of the protective element 29, the kinetic energy of the anchor 17, which causes the connecting arms 43 to flex elastically, generates an axial movement of the outer portion 42 with a subsequent compression of the absorption element 28; a portion of the kinetic energy of the anchor 17 is converted into elastic energy stored in the elastic flexure of the connecting arms 43 and the remainder of the kinetic energy of the anchor 17 is (for the smaller part) converted into elastic energy stored in the absorption element 28 and (for the greater part) dissipated and converted into heat inside the absorption element 28. To prevent the anchor 17 from bouncing against the protective element 29 the total elastic force generated by the elastic energy stored in the absorption element 28 and in the connecting arms 43 of the protection element 29 must be less than the difference between the force of magnetic attraction generated by the electromagnetic actuator 7 on the anchor 17 and the elastic force applied on the anchor 17 by the closing spring 13.

According to a preferred embodiment, the connecting arms 43 can be shaped so as to limit the maximum axial movement between the outer portion 42 and the inner portion 41. In other words, the number, the shape and/or the size of the connecting arms 43 is designed so as to allow an elastic deformation of said connecting arms 43 that enables an axial movement between the outer portion 42 and the inner portion 41 with a maximum stroke; when the axial movement between the outer portion 42 and the inner portion 41 exceeds the maximum stroke, the connecting arms 43 are no longer elastically deformed and thus prevent any further axial movement between the outer portion 42 and the inner portion 41 by acting as a stop for the outer portion 42. Said characteristic of the connecting arms 43 that constitute a stop for the external portion 42 is used to limit the maximum compression of the absorption element 28 and thus limit the maximum stress exerted on the absorption element 28 to within the elasticity limit (thus within the supportable limit with no breaks or permanent deformations) of the resilient material. In other words, the maximum compression of the absorption element 28 is limited by the maximum axial movement of the inner portion 42 that is allowed by the connecting arms 43 so that the absorption element 28 is prevented from being deformed beyond its elasticity limit. In this way, the absorption element 28 has a very long life while still having an extremely limited axial thickness.

We claim:

1. An electromagnetic fuel injector for gaseous fuels comprising:

an injection nozzle controlled by an injection valve;

a movable shutter to regulate the flow of fuel through the injection valve;

an electromagnetic actuator to move the shutter between a closed position and an open position of the injection valve and comprises a fixed magnetic pole, a coil suitable to induce a magnetic flux in the magnetic pole, and a movable anchor magnetically attracted by the magnetic pole; and an absorption element, which is made of a magnetic elastic material and is arranged between the magnetic pole and the anchor; and a protective element made of a magnetic metal material with high surface hardness that is arranged between the absorption element and the anchor, and has at least one portion that is free to move axially towards the absorption element to enable the compression of said absorption element between the anchor and the magnetic pole;

wherein the protective element further includes an inner annular portion, an outer annular portion arranged concentrically around the inner portion, and an elastically deformable interconnecting structure that is mechanically arranged between the inner portion and the outer portion to allow a relative axial movement between the inner portion and the outer portion; and wherein the inner portion is fixed centrally to a protuberance of the magnetic pole arranged centrally and the outer portion is free to move axially with respect to the inner portion due to the elastic deformation of the interconnecting structure; the anchor being shaped so as to only touch the outer portion and not touch the inner portion or the interconnecting structure.

2. The injector according to claim 1, wherein the interconnecting structure includes a plurality of connecting arms, each of which connects the inner portion to the outer portion and has an internal extremity that is integral with the inner portion and an external extremity that is integral with the outer portion.

3. The injector according to claim 2, wherein each connecting arm is arranged circumferentially and has a central part that is perfectly circumferential and wherein the two extremities are joined radially to the inner and outer portions and connected to the central part.

4. The injector according to claim 1, wherein the anchor has a central through hole the radius of which is greater than an outside radius of the interconnecting structure.

5. The injector according to claim 1, wherein the interconnecting structure is shaped to limit the maximum axial movement between the outer portion and the inner portion in order to limit the maximum compression of the absorption element.

6. The injector according to claim 1, wherein the total elastic force generated by the elastic energy stored in the absorption element and in the interconnecting structure after the impact of the anchor is less than the difference between the force of magnetic attraction generated by the electromagnetic actuator on the anchor and an elastic force applied on the anchor by a closing spring.

7. The injector according to claim 1, wherein the magnetic pole has a protuberance arranged centrally thereof; the absorption element and the protective element have a discoidal shape with a hole in the center and are fitted on the centrally arranged protuberance.

8. The injector according to claim 7 further comprising a closing spring, which is compressed between the shutter and the magnetic pole, to push the shutter into the closed position.

9. The injector according to claim 1 further comprising a tubular body having a cylindrical seat which acts as a fuel duct and houses the shutter; a lower portion the tubular body having a number of radial through holes arranged perpendicularly to a longitudinal axis of the tubular body through which fuel enters the cylindrical seat in a radial manner; and a closing disk, which is part of the injection valve, welded laterally to the tubular body beneath the radial holes, the closing disk having a central through hole which defines the injection nozzle.

10. An electromagnetic fuel injector for gaseous fuels comprising:

an injection nozzle controlled by an injection valve;

a movable shutter to regulate the flow of fuel through the injection valve; an electromagnetic actuator to move the shutter between a closed position and an open position of the injection valve and comprises a fixed magnetic pole, a coil suitable to induce a magnetic flux in the magnetic pole, and a movable anchor magnetically attracted by the magnetic pole;

an absorption element, which is made of an a magnetic elastic material and is arranged between the magnetic pole and the anchor; and a protective element made of a magnetic metal material with high surface hardness that is arranged between the absorption element and the anchor, and has at least one portion that is free to move axially towards the absorption element to enable the compression of said absorption element between the anchor and the magnetic pole;

wherein the protective element further includes an inner annular portion, an outer annular portion arranged concentrically around the inner portion, and an elastically deformable interconnecting structure that is mechanically arranged between the inner portion and the outer portion to allow a relative axial movement between the inner portion and the outer portion; and wherein the interconnecting structure includes a plurality of connecting arms, each of which connects the inner portion to the outer portion and has an internal extremity that is integral with the inner portion and an external extremity that is integral with the outer portion.

11. The injector according to claim 10, wherein each connecting arm is arranged circumferentially and has a central part that is perfectly circumferential and wherein the two extremities are joined radially to the inner and outer portions and connected to the central part.

12. The injector according to claim 10, wherein the anchor has a central through hole the radius of which is greater than an outside radius of the interconnecting structure.

13. The injector according to claim 10, wherein the interconnecting structure is shaped to limit the maximum axial movement between the outer portion and the inner portion in order to limit the maximum compression of the absorption element.

14. The injector according to claim 10, wherein the magnetic pole has a protuberance arranged centrally thereof; the absorption element and the protective element have a discoidal shape with a hole in the center and are fitted on the centrally arranged protuberance.

15. The injector according to claim 14 further comprising a closing spring, which is compressed between the shutter and the magnetic pole, to push the shutter into the closed position.

* * * * *